US005132026A

United States Patent [19]

Baluyot et al.

[11] Patent Number: 5,132,026

[45] Date of Patent: Jul. 21, 1992

[54] BLOOD PLASMA COLLECTION SYSTEM

[75] Inventors: Rodolfo C. Baluyot, West Covina; Jesus Betancourt, Upland; David M. Dimmick, Orange; Patricia M. Hajduk, Redondo Beach, all of Calif.

[73] Assignee: Alpha Therapeutic Corporation, Los Angeles, Calif.

[21] Appl. No.: 675,088

[22] Filed: Mar. 21, 1991

[51] Int. Cl.[5] ..... A61B 19/00

[52] U.S. Cl. ..... 210/767; 210/85; 210/257.1; 220/23.4; 220/23.83; 422/102; 436/177; 604/403; 604/405; 604/409

[58] Field of Search ..... 210/782, 789, 85, 257.1, 210/767, 516; 422/102; 436/177; 604/403, 404, 405, 409; 220/23.83, 23.4

[56] References Cited

U.S. PATENT DOCUMENTS

| | | | |
|---|---|---|---|
| 4,160,473 | 7/1979 | Winchell | 604/409 |
| 4,508,236 | 4/1985 | Keilman et al. | 215/308 |
| 4,568,345 | 2/1986 | Keilman et al. | 604/403 |
| 5,019,243 | 5/1991 | McEwen et al. | 210/516 |

*Primary Examiner*—W. Gary Jones

*Attorney, Agent, or Firm*—Christie, Parker & Hale

[57] ABSTRACT

A blood plasma collection system comprises a sealed collection bottle with a flexible plastic transfer tube sealed into its top for collecting plasma. A flexible sample tube is also sealed into the top of the bottle and connects to a sample vial for receiving a plasma sample decanted from the bottle. The sample vial is sealed to the sample tube by a resilient plug. A vent tube and filter are also be connected to the plug. This permits a representative plasma sample to be decanted from the bottle into the sample vial after plasma is collected.

11 Claims, 2 Drawing Sheets

BLOOD PLASMA COLLECTION SYSTEM

BACKGROUND OF THE INVENTION

This invention relates to a plasma collection bottle with an integral sample vial for taking a representative sample of contents of the bottle for analysis.

Blood plasma is obtained from donors by techniques that differ somewhat from donation of whole blood in a technique known as plasmapheresis. In a manual pheresis technique, a donation of several hundred milliliters of whole blood is withdrawn from the donor into a plastic bag. The blood donation is then separated in a centrifuge and the clear plasma is withdrawn and transferred to a "pooling bottle". The remaining fraction of blood containing the red cells is diluted with saline and reinjected into the donor. After a suitable lapse of time another donation of several hundred milliliters is withdrawn from the donor. Again, the sample is separated by a centrifuge and another portion of plasma is transferred to the pooling bottle. The remaining red cells are again diluted and reinjected into the donor.

Alternatively, the plasma is obtained by a technique referred to as autopheresis. Whereas, manual pheresis is a batch technique, autopheresis is continuous. Whole blood is withdrawn from the donor, a plasma fraction is separated continuously and the red cell fraction is reinjected continuously.

In either case the plasma is transferred to a pooling bottle which is typically a one-liter sealed plastic bottle made of medical grade ethylene-propylene copolymer. A similar bottle is used for either manual plasmapheresis or autopheresis. The only difference is that with autopheresis there is a single medical grade polyvinyl chloride (pvc) transfer tube for introducing plasma into the bottle, whereas, for manual pheresis there is a Y-connection near the top of the bottle and two transfer tubes are used for receiving the two batches of plasma.

A complication of manual pheresis is that there are occasions when plasma donations from more than one donor are inadvertently commingled in a single pooling bottle via two transfer tubes. If a sample is taken from only one of the transfer tubes, it cannot be representative of the plasma from both donors.

A second flexible pvc tube is connected to the top of the bottle and is closed with a sufficiently fine filter to permit air to vent from the bottle as it is filled and prevent microorganisms from entering the sterile bottle.

After the plasma is transferred to the pooling bottle, the transfer tube and the vent tube are heat sealed and severed so that the plasma is completely sealed inside the bottle and isolated from contamination. After collecting the plasma donations they are frozen and shipped to central facilities where large amounts of plasma from a broad variety of donors is commingled and processed for recovering valuable fractions used for a variety of medical purposes.

It is extremely important that any plasma that is contaminated be identified so that it is not commingled with usable plasma, since this could result in hazard to a large number of patients receiving fractions from the processed plasma. For example, it is important that the plasma be assayed for viral contamination such as HIV which could be life threatening. Samples of the plasma are therefore taken from each donation for laboratory analysis. Such analyses are performed in a central laboratory separate from the collection centers, and sometimes separate from the plasma processing facilities. The samples of plasma for analysis must therefore be carefully and accurately correlated with the plasma in the pooling bottle so that if contamination is identified, the plasma in the pooling bottle may be diverted from commingling with other plasma.

Current practice has been to mark a short heat-sealed length of the flexible transfer tube with indicia identical to that on the pooling bottle and ship the sealed transfer tube to a testing laboratory. There the transfer tube is cut and the plasma drained into a suitable test tube or other vial for analysis. This is not only inconvenient, but there is a possibility of extraneous contamination and a minor hazard to personnel where the transfer tubes are cut.

Through labeling errors, there may also be a risk of mixing up transfer tubes and losing correlation with the plasma in the pooling bottles. Furthermore, the sample of plasma in each transfer tube is representative only of a portion of the plasma transferred and is not necessarily representative of the plasma in the pooling bottle. This is particularly true of the manual pheresis technique where the sample in one of the transfer tubes is representative only of one of the batches of plasma commingled in the pooling bottle, and if there is an inadvertent pooling of plasma from two donors, serious errors may occur. The practice has been to use the first transfer tube for a sample. This, of course, is highly risky if plasma from more than one donor is transferred into the pooling bottle since the second transfer may be contaminated and would not be represented in the sample.

It is therefore desirable to provide a plasma collection and sampling system which provides samples representative of the contents of the pooling bottle and which has a high degree of reliability for accurate correlation between an analysis sample and the pooling bottle. It is desirable that the technique provided for obtaining a sample is convenient, safe, reliable, accurate and compatible with automated testing equipment.

BRIEF SUMMARY OF THE INVENTION

There is, therefore, provided in practice of this invention according to a presently preferred embodiment, a blood plasma collection system having a sealed plasma collection bottle with a flexible transfer tube sealed into the top of the bottle for collecting plasma. A flexible sample tube is also sealed into the top of the bottle and connects to a removable sample vial for receiving a plasma sample decanted from the bottle. A vent is connected to the sample vial so that the bottle is vented during filling and the sample vial is vented when a sample is transferred. Preferably, indicia on the collection bottle and sample vial are identical for correlating the sample with the contents of the bottle.

BRIEF DESCRIPTION OF THE DRAWINGS

These and other features and advantages of the invention will be appreciated as the same becomes better understood by reference to the following detailed description when considered in connection with the accompanying drawings wherein.

DETAILED DESCRIPTION

Figure 3:
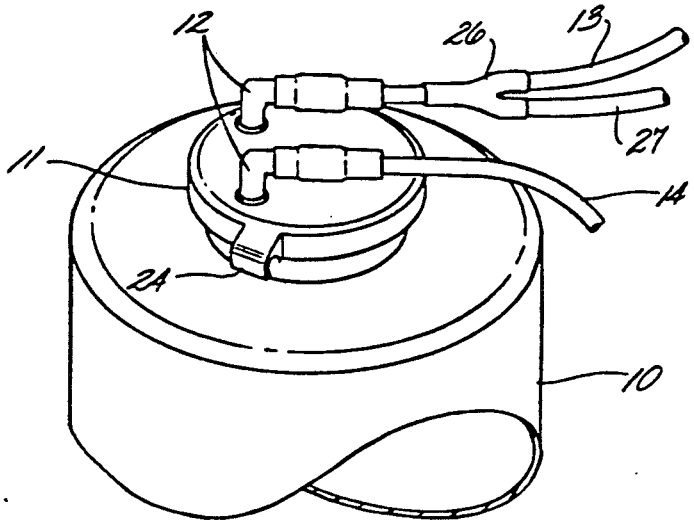
FIG. 3 is a fragmentary isometric view of the top of a bottle having two transfer tubes.

Preferably, in practice of this invention the plasma collection bottle 10 comprises a conventional one liter plasma pooling bottle of ethylene-propylene copolymer of the type long ago approved for medical uses. High density polyethylene may also be used. At the top of the bottle there is a short neck or cap 11 integral with the bottle. A pair of L-shaped connector taps 12 protrude from the cap. An elongated flexible medical grade pvc transfer tube 13 is connected to one of the connector taps. If the pooling bottle is to be used for manual plasmapheresis a Y connector 26 (FIG. 3) with two flexible transfer tubes 13 and 27 is connected to one of the connector taps. In other words, bottles are assembled with either one or two transfer tubes. This much of this system is conventional.

Figure 1:
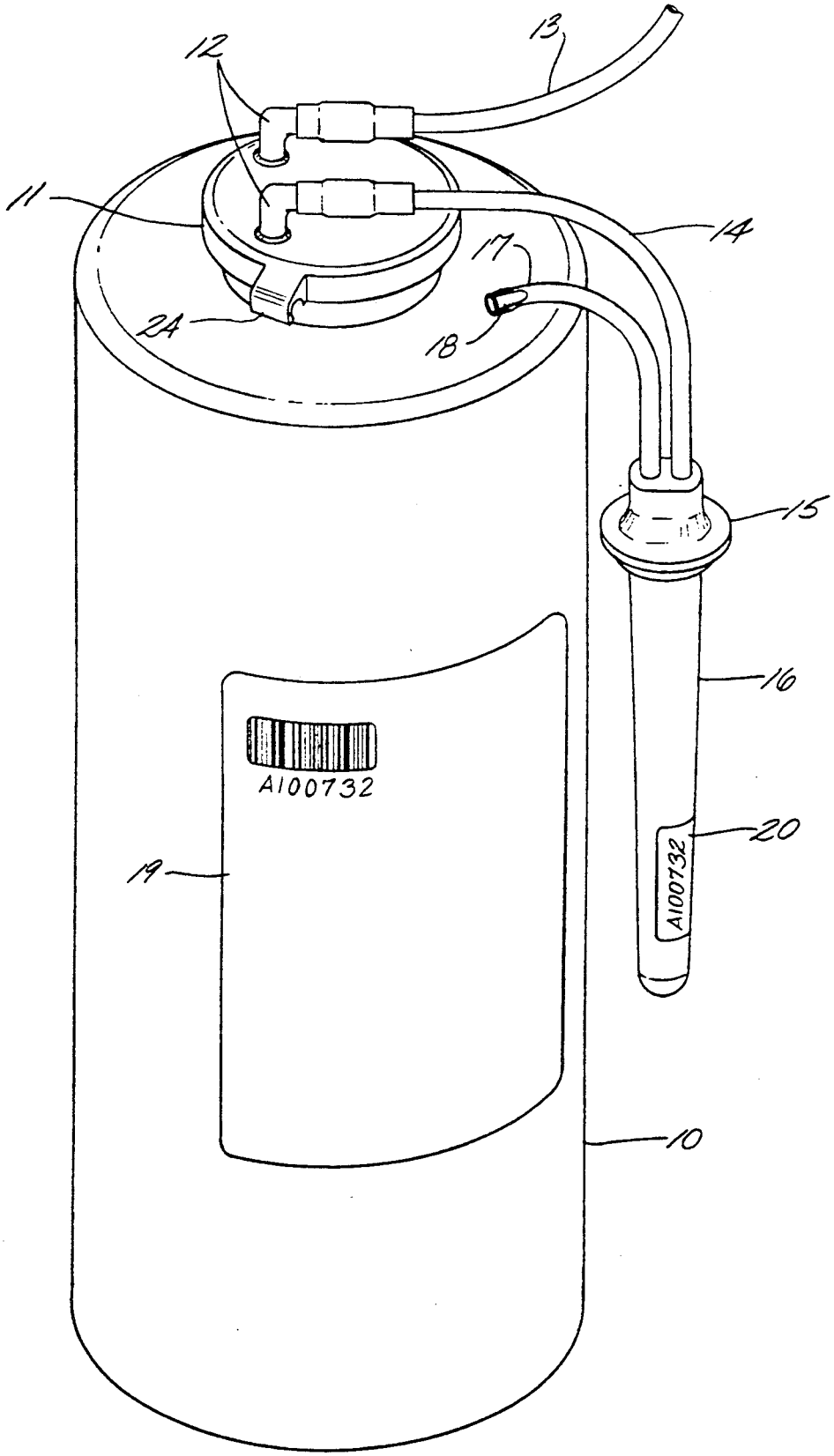
FIG. 1 is an isometric view of a plasma collection bottle and sample vial constructed according to principles of this invention.
Figure 2:
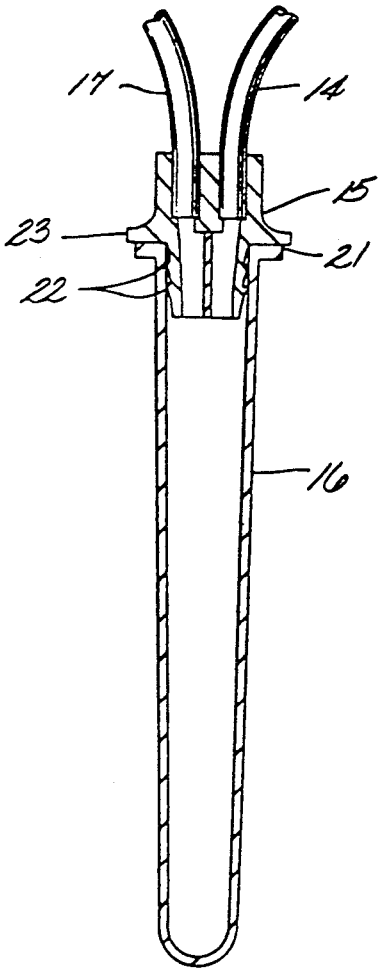
FIG. 2 is a longitudinal cross section of a sample vial.

A flexible pvc sample tube 14 is connected to the second of the L-shaped connector taps on the top of the bottle. The other end of the transfer tube is bonded into a resilient pvc cap or plug 15. The resilient plug is removably inserted into the end of a rigid test tube or sample vial 16. The sample vial is preferably made of an ethylene-propylene copolymer similar to that used for making the pooling bottle. The resilient plug has two through holes (FIG. 2) with the transfer tube 14 bonded in one of them and a flexible pvc vent tube 17 bonded in the other one. A vent filter 18 of the same type as previously employed is force fitted into the end of the vent tube for venting air and preventing microorganisms from entering the closed, sterile and non-pyrogenic system.

The pooling bottle bears a permanent label 19 with alphanumeric and bar code indicia uniquely identifying the bottle. Similarly, the sample vial 16 has a permanent label 20 having identical alphanumeric and bar code indicia providing a positive and accurate correlation between the sample vial and the pooling bottle. Space may be provided for adding a bar code bleed number sticker.

The sample vial is a test tube having a capacity of approximately 5 mL. Graduation markings to show sample volume may be provided on the wall of the sample vial, if desired. At the top there is an enlarged flange 21. This permits the sample vial to be held for automatic insertion of plugs during assembly.

The resilient plug fits tightly within the open top of the sample vial. The plug has a pair of sealing flanges 22, each having a long taper toward the end inserted into the sample vial for ease of insertion. The upper end of each flange is, on the other hand, abrupt for inhibiting removal from the vial. The outside diameter of each of the sealing flanges is appreciably larger than the inside diameter of the sample vial so that there is a tight frictional engagement and seal between the plug and vial. A tight fit is desired so that the plug is not accidentally dislodged from the sample vial.

The plug also has an enlarged flange 23 near its middle which is larger than the flange on the sample vial to assist in removing the plug from the vial when desired. A small amount of lubricant such as cyclohexanone may be used on the plug for easing insertion of the plug into the vial.

The entire plasma collection assembly of pooling bottle, transfer tube (or tubes), sample tube, sample vial and vent tube is a closed system. After packaging the system is sterilized by exposure to gamma radiation.

When the assembly is used, a transfer tube is connected to the plasmapheresis system in a conventional manner and plasma is transferred into the bottle. Air from the bottle vents through the filter. When the plasmapheresis procedure is completed and the pooling bottle is filled to capacity, the transfer tube is heat sealed and pinched off. The plasma collected in the bottle is then swirled to assure thorough mixing. The bottle is tilted so that plasma from the bottle decants into the sample vial. Air from the vial vents through the filter. If need be, the sides of the plastic collection bottle, which are slightly flexible, may be squeezed to assure transfer of plasma into the sample vial. After the desired size of sample has been decanted from the plasma bottle, the sample tube between the bottle and vial is heat sealed and severed. This leaves the principal volume of plasma sealed inside the pooling bottle for processing in the usual manner. The vent tube is also heat sealed and pinched off, thereby sealing the sample in the sample vial.

Small "ears" 24 are provided on the top of the bottle, with an undercut groove into which the severed ends of the sample tube and transfer tube may be fitted to keep the ends out of the way, if desired.

The sample vial can then be shipped to the analytical laboratory where the plug can be removed and analysis performed directly from the sample vial. No hazardous cutting nor likelihood of contamination from a transfer tube is involved. Furthermore, since the plasma in the sample vial is decanted directly from the plasma in the pooling bottle, its composition is representative of the plasma in the bottle. Accurate correlation of the indicia on the labels on the vial and bottle permit diversion of plasma if any contamination is discovered.

Although but one embodiment of plasma collection system has been described and illustrated herein, it will be apparent that there are modifications and variations that may be made in practice of this invention. Thus, for example, the flexible tubing and resilient plug are made of medical grade pvc. Other materials may also be suitable, although it is desirable that they be heat sealable for freedom from contamination and ease of use. Similarly, although the sample vial has a resilient plug in this embodiment, a similar result may be obtained by providing a removable cap sealed on the sample vial Such a cap can be threaded onto the flange on the sample vial or have a bayonet fit, for example. Other such modifications and variations will be apparent to those skilled in the art and it is therefore to be understood that within the scope of the appended claims, the invention may be practiced otherwise then as specifically described.

What is Claimed is:

1. A blood plasma collection system comprising:

a sealed plasma collection bottle;

a flexible transfer tube connected to the top of the bottle for collecting plasma;

a flexible sample tube connected to the top of the bottle;

a removable sample vial connected to the sample tube for receiving a plasma sample decanted from the bottle; and a vent connected to the sample vial.

2. A plasma collection system as recited in claim 1 further comprising indicia on the collection bottle and indicia on the sample vial for correlating the sample in the vial with the contents of the bottle.

3. A plasma collection system as recited in claim 1 wherein the sample vial comprises:

a rigid test tube;

a resilient plug in the test tube, the plug comprising means for maintaining a seal to the test tube; and a pair of passages through the plug, the sample tube being sealed through one of the passages, and the vent being sealed to the other passage.

4. A plasma collection system as recited in claim 3 wherein the vent comprises a flexible tube connected to the passage and an air filter fine enough to prevent passage of microorganisms.

5. A plasma collection system as recited in claim 1 wherein the flexible tubes are each made of heat sealable material.

6. A plasma collection system as recited in claim 1 wherein the transfer tube comprises a Y having a leg connected to the bottle and an arm connected to the other end of the transfer tube and a second transfer tube connected to the other arm of the Y for collecting more than one plasma donation.

7. A blood plasma collection system comprising:

a sealed plasma collection bottle, the walls of the bottle being at least slightly flexible;

at least one heat sealable, flexible medical grade plastic transfer tube connected to the top of the bottle for collecting plasma;

a heat sealable, flexible medical grade plastic sample tube connected to the top of the bottle;

a resilient plug sealed on the end of the sample tube;

a rigid sample vial frictionally engaged on the plug for receiving a plasma sample decanted from the bottle through the sample tube;

a heat sealable, flexible medical grade plastic vent tube sealed to the plug for venting air from the vial; and an air filter in the vent tube fine enough to prevent passage of microorganisms into the vial.

8. A plasma collection system as recited in claim 7 wherein the transfer tube comprises a Y having a leg connected to the bottle and an arm connected to the other end of the transfer tube and a second transfer tube connected to the other arm of the Y for collecting more than one plasma donation.

9. A plasma collection system as recited in claim 7 further comprising:

first indicia on the collection bottle for identifying plasma in the collection bottle; and identical indicia on the sample vial for correlating the sample vial with the collection bottle.

10. A method for sampling collected blood plasma comprising the steps of:

collecting plasma in a sealed collection bottle;

decanting a portion of the plasma from the collection bottle into a sample vial sealed to the collection bottle by a flexible tube; and heat sealing and severing the sample tube for sealing both the bottle and the vial and separating the vial from the bottle.

11. A method as recited in claim 10 further comprising venting air from the vial during the decanting.

* * * * *